US007892146B2

(12) United States Patent
Nakanishi et al.

(10) Patent No.: US 7,892,146 B2
(45) Date of Patent: Feb. 22, 2011

(54) ROCKING TYPE EXERCISING APPARATUS

(75) Inventors: Ryusuke Nakanishi, Nagoya (JP); Izumi Mihara, Osaka (JP); Nozomu Toyama, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 102 days.

(21) Appl. No.: 12/230,477

(22) Filed: Aug. 29, 2008

(65) Prior Publication Data

US 2009/0062075 A1 Mar. 5, 2009

(30) Foreign Application Priority Data

Aug. 31, 2007 (JP) ..... 2007-227192
Sep. 25, 2007 (JP) ..... 2007-248179

(51) Int. Cl.
*A63B 21/005* (2006.01)
*A63B 22/04* (2006.01)
*A63B 71/00* (2006.01)
*A63B 23/00* (2006.01)

(52) U.S. Cl. ..... 482/5; 482/51; 482/148

(58) Field of Classification Search ..... 482/1, 482/4–9, 51, 148, 77, 145; 472/95–97, 102, 472/135; 434/258, 247
See application file for complete search history.

(56) References Cited

U.S. PATENT DOCUMENTS 5,848,939 A * 12/1998 Smith ..... 472/60
6,402,626 B1 * 6/2002 Beaty ..... 472/96
6,488,640 B2 * 12/2002 Hood et al. ..... 601/23
6,835,141 B2 * 12/2004 Eaves ..... 472/97
6,964,614 B1 * 11/2005 Tsai ..... 472/58
7,104,927 B2 * 9/2006 Tsai ..... 482/51
7,121,831 B2 * 10/2006 Hojo et al. ..... 434/247
7,347,806 B2 * 3/2008 Nakano et al. ..... 482/51
7,448,953 B2 * 11/2008 Chen ..... 472/96
2006/0025226 A1 * 2/2006 Nakano et al. ..... 472/97
2006/0073940 A1 * 4/2006 Nakanishi ..... 482/51
2006/0079800 A1 4/2006 Martikka et al.
2008/0009395 A1 * 1/2008 Tseng ..... 482/51

FOREIGN PATENT DOCUMENTS

EP 1 621 236 2/2006
JP 11-004911 1/1999
JP 2001-286578 10/2001
JP 2007-167289 7/2007
WO 2006/065679 6/2006

OTHER PUBLICATIONS

Light Commercial EFX Owner's Manual, EFX 524. Woodinville, WA: Precor Incorporated, 2003. Print.*
Corresponding Korean Office Action dated Oct. 25, 2010 and English Abstract.

* cited by examiner

*Primary Examiner*—Loan Thanh
*Assistant Examiner*—Sundhara M Ganesan
(74) *Attorney, Agent, or Firm*—Bacon & Thomas, PLLC

(57) ABSTRACT

A rocking type exercising apparatus includes a movable unit on which a user rides, a driving unit for causing the movable unit to perform a rocking motion, and a rocking motion changing unit for changing the rocking motion of the movable unit driven to rock by the driving unit. The rocking type exercising apparatus also includes a display unit, responsive to the change in the rocking motion caused by the rocking motion changing unit, for displaying loads to be applied to a plurality of body regions of the user.

6 Claims, 13 Drawing Sheets

ROCKING TYPE EXERCISING APPARATUS

FIELD OF THE INVENTION

The present invention relates to a rocking type exercising apparatus for providing a user with an exercising effect similar to a horse riding by rocking a seat on which the user sits and for urging the user to maintain a balance by rocking treadles on which the user straddles.

BACKGROUND OF THE INVENTION

A rocking type exercising apparatus for providing a user with an exercising effect similar to a horse riding is an easy-to-use exercising apparatus that is widely used among users of various generations from children to elderly persons and is spread to general households as well as rehabilitation purpose medical facilities. Examples of the conventional rocking type exercising apparatus are disclosed in, e.g., Japanese Patent No. 3394890 and Japanese Patent Laid-open Application No. 2001-286578.

Japanese Patent No. 3394890 discloses a prophylactic training apparatus for lumbago that can realize rhythmical rocking motions using a parallel mechanism having a leeway of movement in six different directions or the like. Japanese Patent Laid-open Application No. 2001-286578 discloses a balance training apparatus that can realize a forward/backward rocking motion and a leftward/rightward rocking motion using a motor and a link.

The intensity and ratio of the loads applied to different body regions of a user during the rocking motion of a movable unit varies with the posture and speed of the movable unit. With the conventional apparatuses, however, there is no way for the user to know the nature of load applied to a specified body region before the user actually undergoes and empirically feels the rocking motion by exercising himself/herself.

SUMMARY OF THE INVENTION

In view of the above, the present invention provides a rocking type exercising apparatus capable of clarifying to the user in which body region the intensity of a load is increased or decreased depending on a change in posture and speed.

In accordance with the present invention, there is provided a rocking type exercising apparatus including: a movable unit on which a user rides; a driving unit for causing the movable unit to perform a rocking motion; a rocking motion changing unit for changing the rocking motion of the movable unit driven to rock by the driving unit; and a display unit, responsive to the change in the rocking motion caused by the rocking motion changing unit, for displaying loads to be applied to a plurality of body regions of the user.

With the rocking type exercising apparatus described above, the change in the loads to be applied to different body regions, which results from the change in the rocking motion, is presented to the user.

The rocking motion changing unit may change at least one of a posture, a speed and a movement trajectory of the movable unit.

If the movable unit is a seat on which the user sits, and the rocking motion changing unit changes a forward/backward inclination angle of the seat, the display unit may preferably display loads to be applied to abdominal muscles, back muscles, front-of-thigh muscles and back-of-thigh muscles.

In accordance with the embodiment of the present invention, if the rocking motion of the movable unit is changed, there are displayed in advance the body regions to which loads are to be applied by the changed rocking motion and the nature of loads to be applied to those body regions, thereby enabling the user to clearly know for which body region the rocking motion works effectively. Therefore, it is possible for the user to recognize what kind of rocking motion needs to be performed to increase an exercise amount to a target body region.

BRIEF DESCRIPTION OF THE DRAWINGS

The object and features of the present invention will become apparent from the following description of embodiments given in conjunction with the accompanying drawings, in which.

DETAILED DESCRIPTION OF THE EMBODIMENT

Hereinafter, an exemplary embodiment of the present invention will be described with reference to FIGS. 1 to 13, which form a part hereof.

Figure 2:
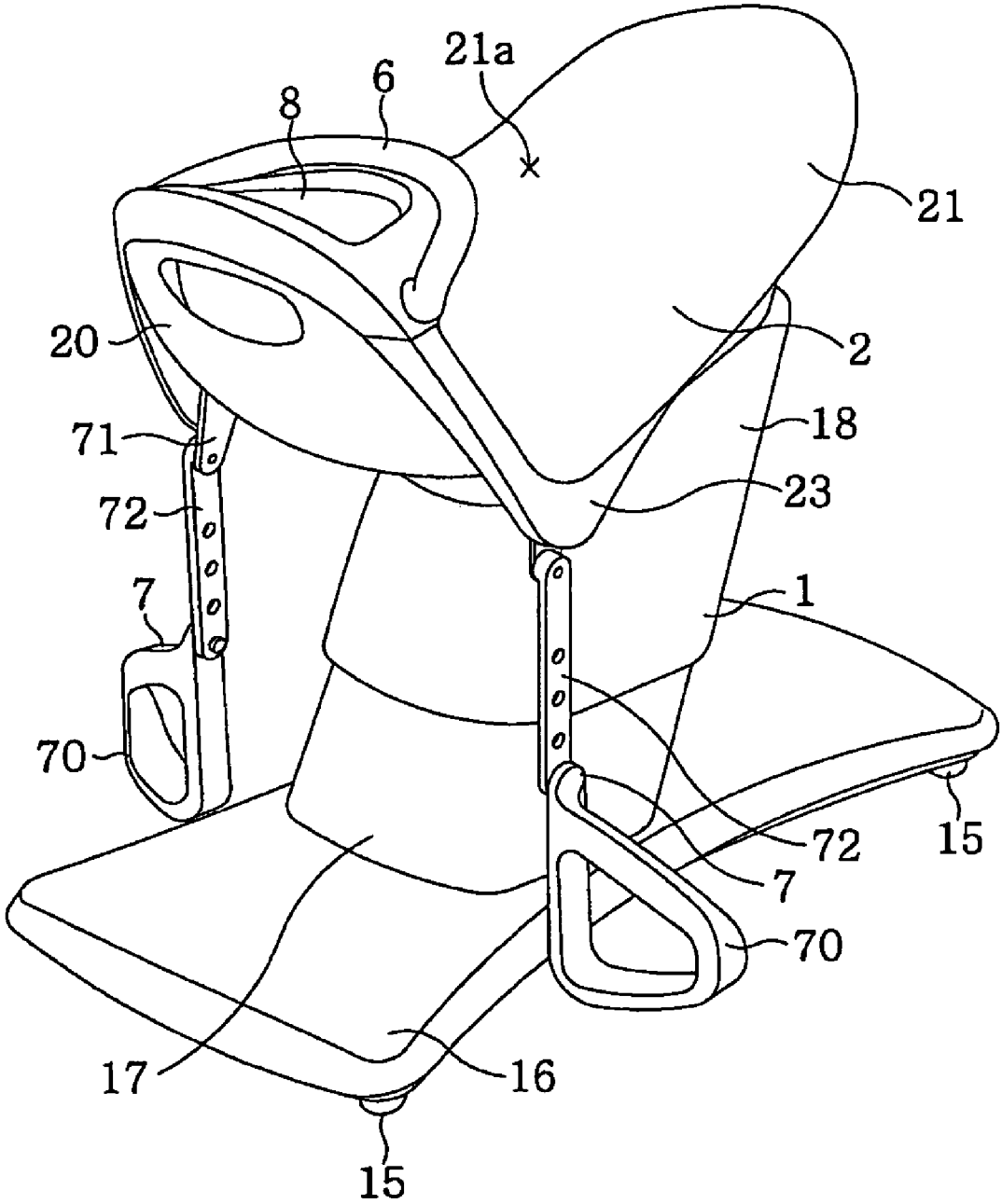
FIG. 2 is a perspective view of the rocking type exercising apparatus.
Figure 3A:
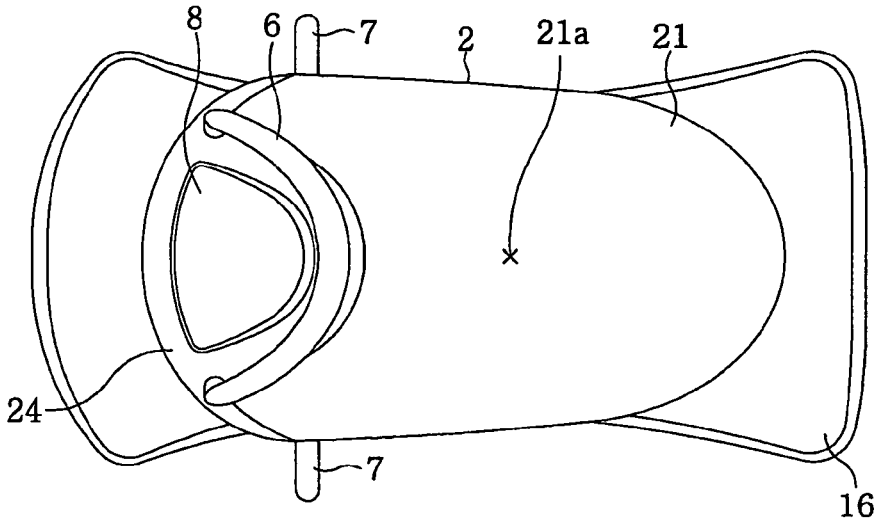
FIGS. 3A and 3B are plan and right side views of the rocking type exercising apparatus.
Figure 3B:
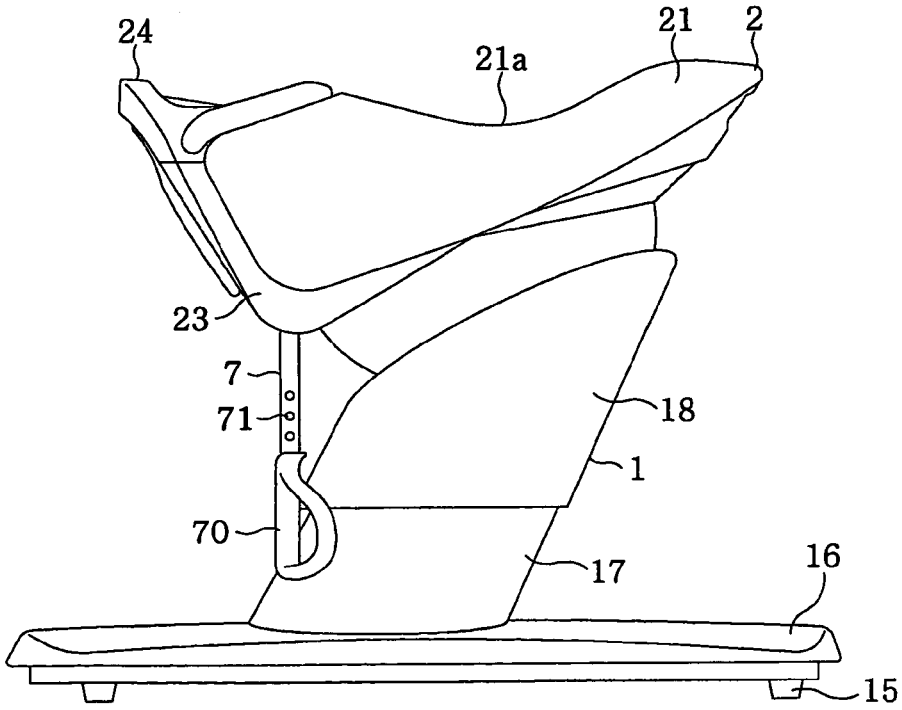
Figure 4:
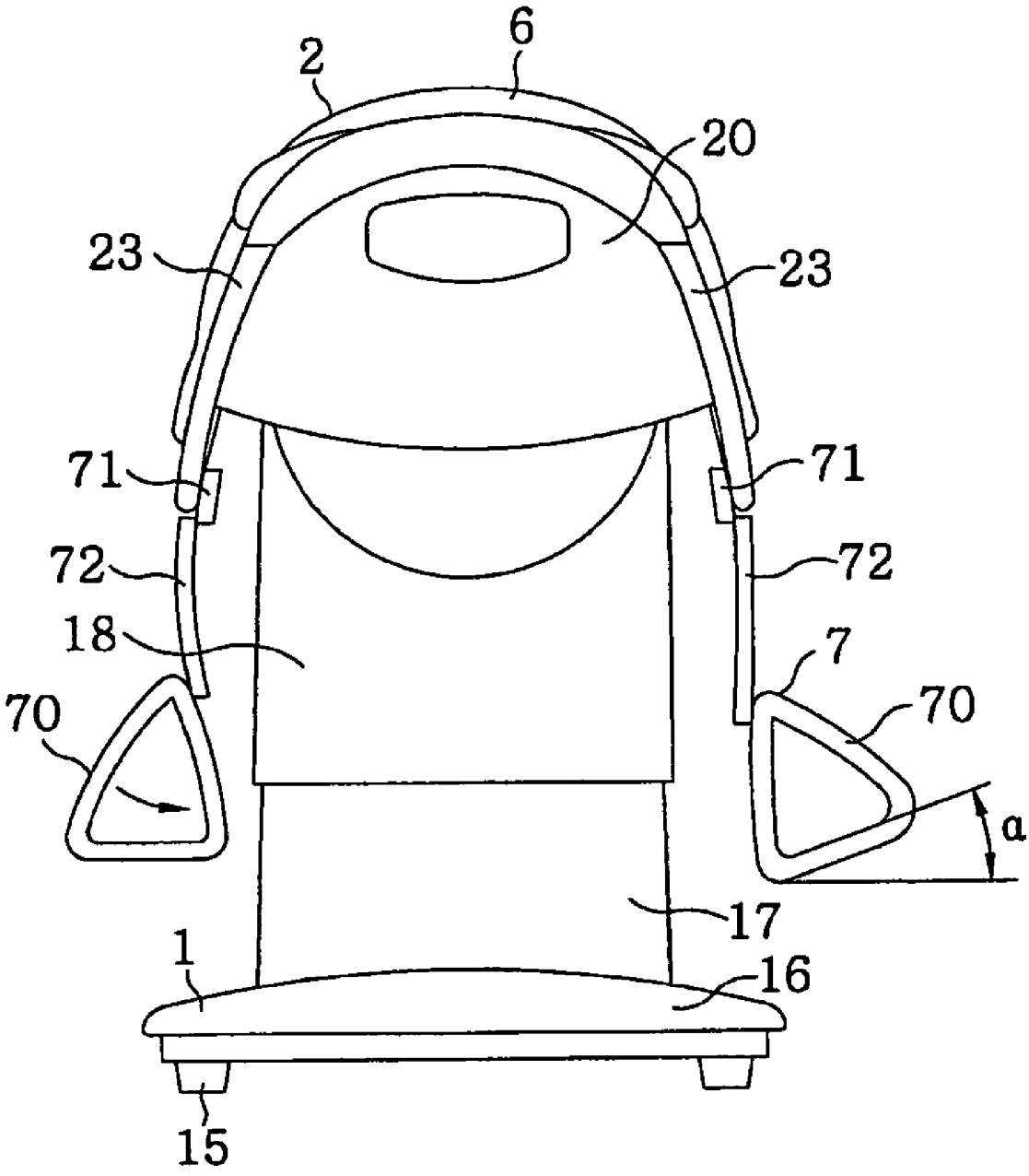
FIG. 4 is a front view of the rocking type exercising apparatus.

The rocking type exercising apparatus shown in FIGS. 2 and 3 is designed to cause forward/backward and leftward/rightward rocking motions to a seat 2 on which a user sits, so that the user sitting on the seat 2 can take an exercise for balance training purposes. The rocking type exercising apparatus includes a seat 2 imitating a horseback or a saddle in shape and having a top seat surface, a driving unit 3 for causing a rocking motion to the seat 2 and a main body 1 for receiving the driving unit 3 within an upper portion thereof. A generally semicircular arc-shaped rein 6 is connected at its opposite ends to the front end side of the seat 2 in a manner that the rein 6 is pivotably moved in the forward/backward direction. An operation panel 8 is also provided on the front end side of the seat 2. Stirrup members 7 and 7 are suspended from the opposite flanks of the seat 2 near the front end of the latter.

Figure 5:
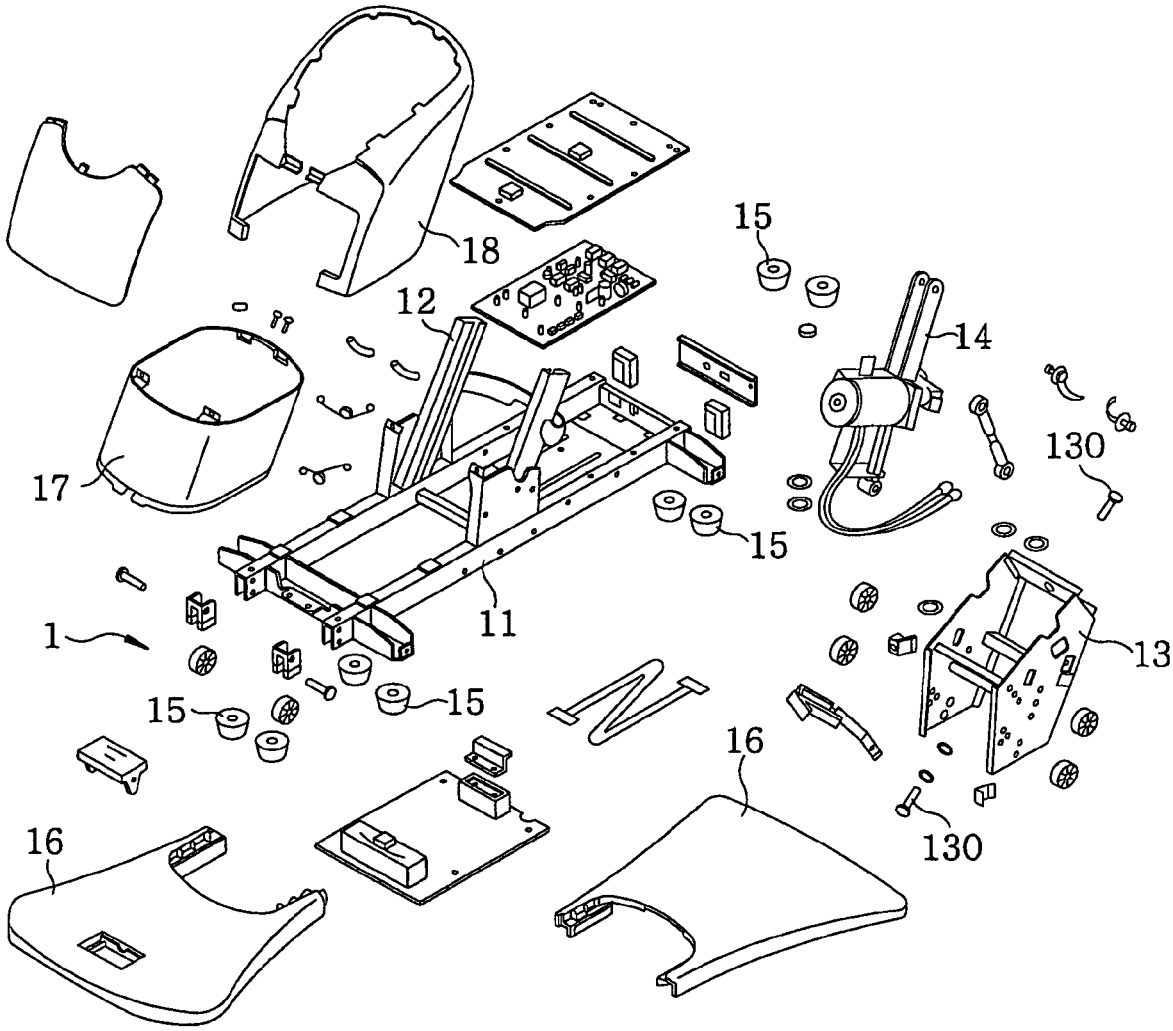
FIG. 5 is an exploded perspective view showing a main body unit of the rocking type exercising apparatus.

As can be seen in FIG. 5, the main body 1 includes a base frame 11 having ground-contacting legs 15 at its four corners, a post 12 extending upwardly and rearwardly from the generally central portion of the base frame 11, a support frame 13 attached to the post 12 in a manner that the support frame 13 is slidably movable in the longitudinal direction of the post 12 and an electrical sliding unit 14 for performing the sliding movement of the support frame 13 with electric power. The main body 1 further includes a base cover 16 for covering the upper surface of the base frame 11, a cover 17 for covering the vicinity of the post 12, and a main cover 18 for covering the outer circumference of the support frame 13.

Figure 6:
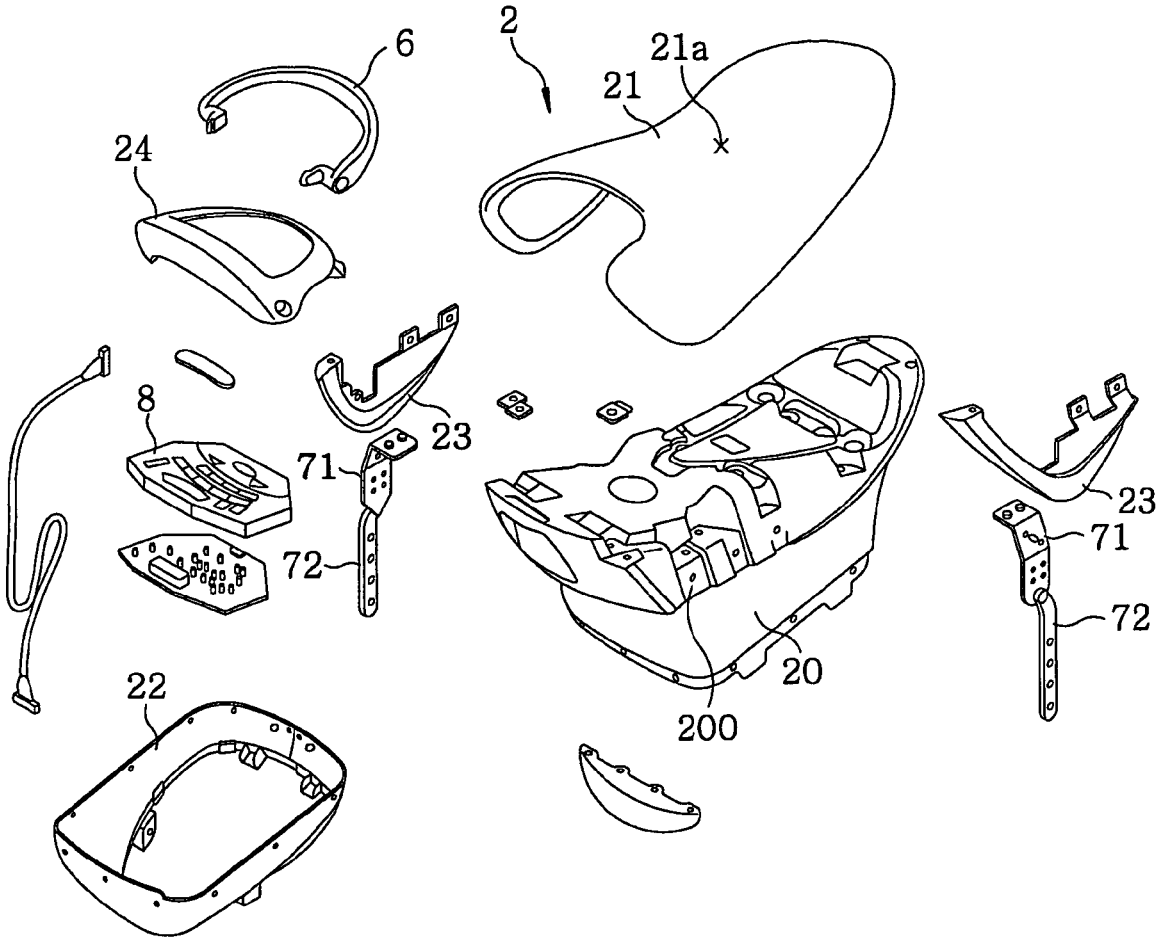
FIG. 6 is an exploded perspective view showing a seat of the rocking type exercising apparatus.
Figure 7:
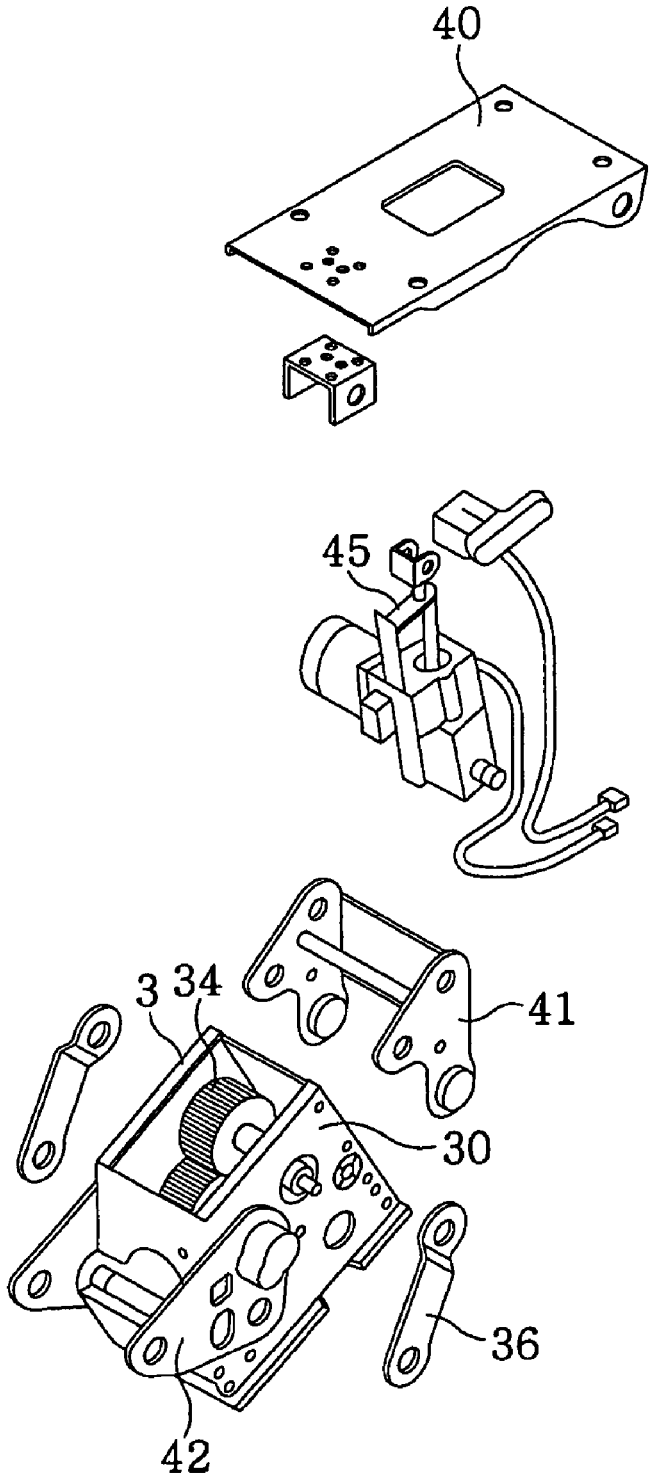
FIG. 7 is an exploded perspective view showing a driving unit of the rocking type exercising apparatus.
Figure 8:
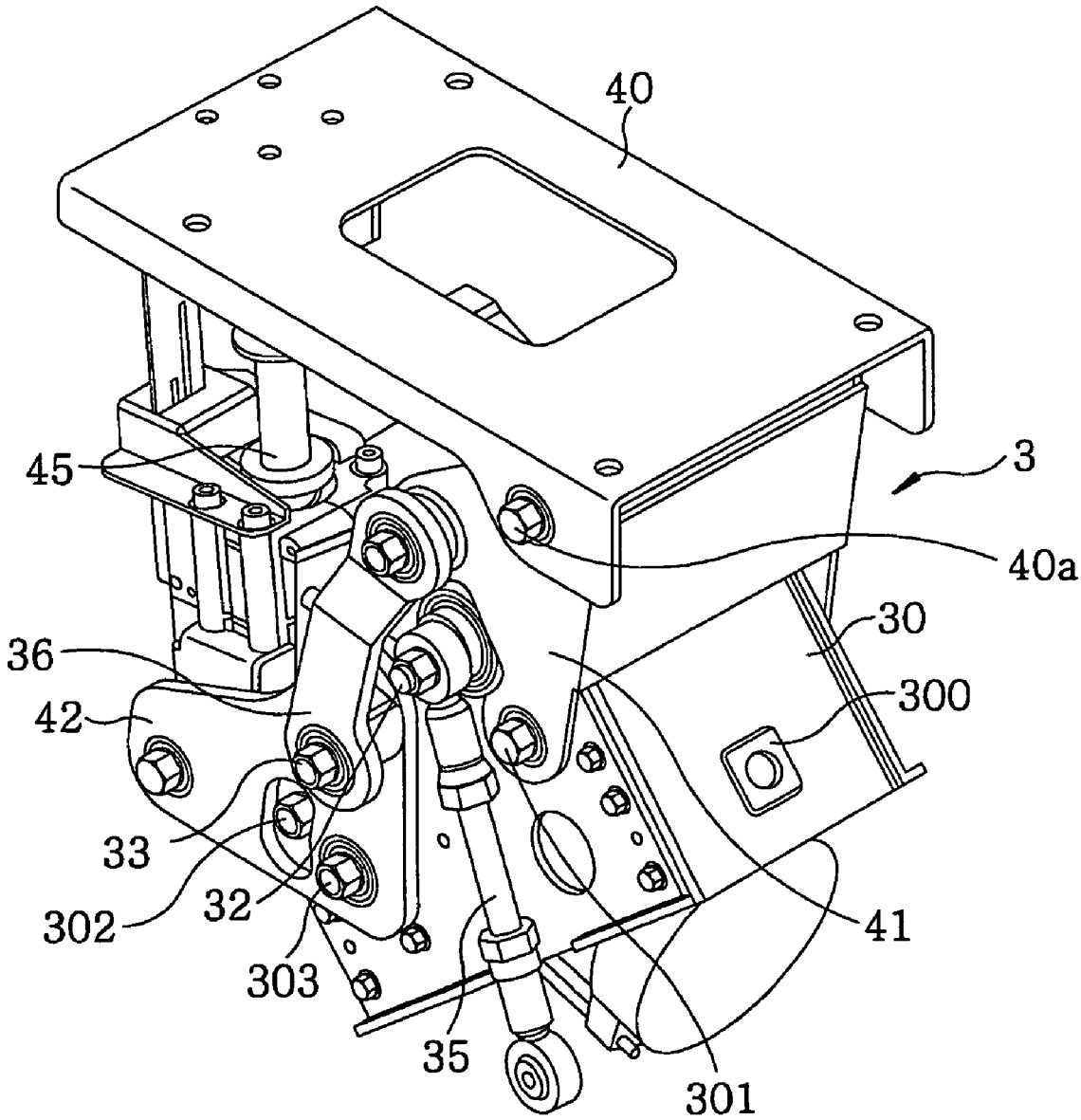
FIG. 8 is a perspective view of the driving unit of the rocking type exercising apparatus.

Referring to FIG. 6, the seat 2 includes a seat frame 20, a seat surface member 21 attached to the upper surface of the seat frame 20, a cover 22 joined to the lower side of the seat frame 20, a pair of protection covers 23 attached to the left and right sides of the seat frame 20, and a panel cover 24 for covering the vicinity of the operation panel 8.

Each of the stirrup members 7 includes a fixed piece 71 fixedly secured to a stirrup attachment portion 200 formed on each side surface of the seat frame 20, a connection piece 72 suspended from the fixed piece 71, and a foot rest 70 suspended from the connection piece 72. Each of the protection covers 23 covers the outer end of a joint pin portion by which the connection piece 72 is joined to the fixed piece 71, thereby preventing a possibility that the knee portion of the user sitting on the seat 2 comes into contact with the joint pin portion.

The driving unit 3 will now be described. Referring to FIGS. 7 to 10, the driving unit 3 includes a movable frame 30 formed into a box-like shape, a motor 31 arranged within the movable frame 30, a gear group 34 arranged within the movable frame 30 for transferring the torque of the motor 31 to a couple of output shafts 32 and 33, a movable plate 40 positioned above the movable frame 30, and two kinds of link plates 41 and 42 for connecting the movable plate 40 to the movable frame 30. The gear group 34 serves as a speed reduction means which reduces a rotational speed of the motor. The movable frame 30 has bearing portions 300 at its front and rear end surfaces. The bearing portions 300 of the movable frame 30, are rotatably attached to the support frame 13 of the main body 1 by respective shafts 130 (shown in FIG. 5), so that the movable frame 30 swings in the leftward and rightward directions about the shafts 130.

In this regard, the link plate 41 connected to the rear end side of the movable plate 40 is coupled to the rear side surfaces of the movable frame 30 by means of a shaft 301. A rotating plate 39 is arranged within the movable frame 30 and is supported at one end by the movable frame 30 by means of a shaft 302. The link plate 42 is supported by the other end of the rotating plate 39 by means of a shaft 303. Furthermore, the link plate 42 is connected to the front end of the movable plate 40 through an extensible/contractible actuator 45.

The two output shafts 32 and 33 are pivotably driven, of which the output shaft 32 has an off-centered portion lying on the external surface of the movable frame 30. The off-centered portion is connected to the support frame 13 through a link 35.

The output shaft 33 has two off-centered portions 33*a* and 33*b* lying on the external surface of the movable frame 30. The off-centered portion 33*a* with reduced eccentricity is connected to the link plate 42, while the off-centered portion 33*b* with increased eccentricity is connected to one end of a connection link 36 of which the other end is connected to the link plate 41.

Figure 9:
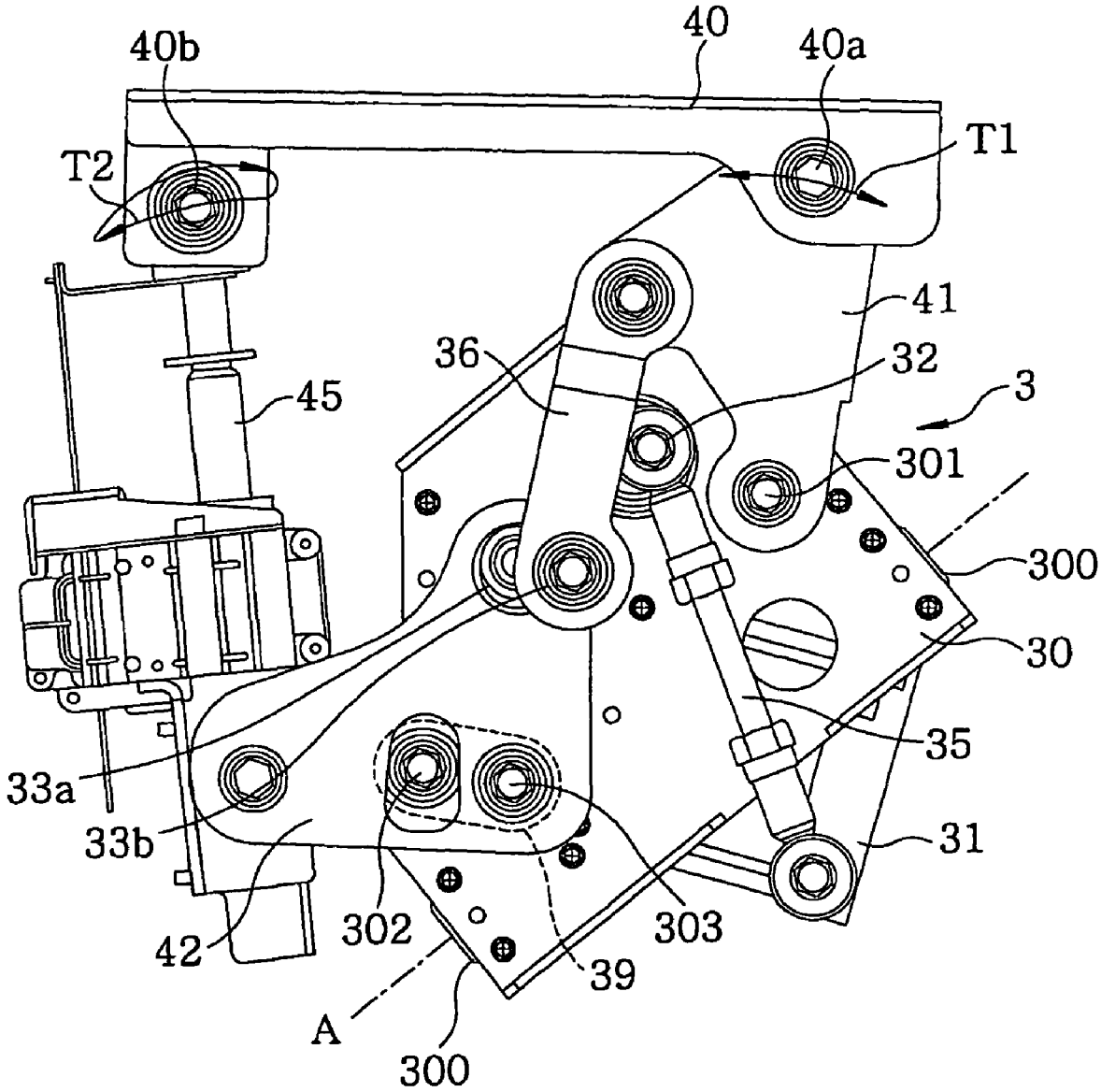
FIG. 9 is a side view of the driving unit of the rocking type exercising apparatus.
Figure 10:
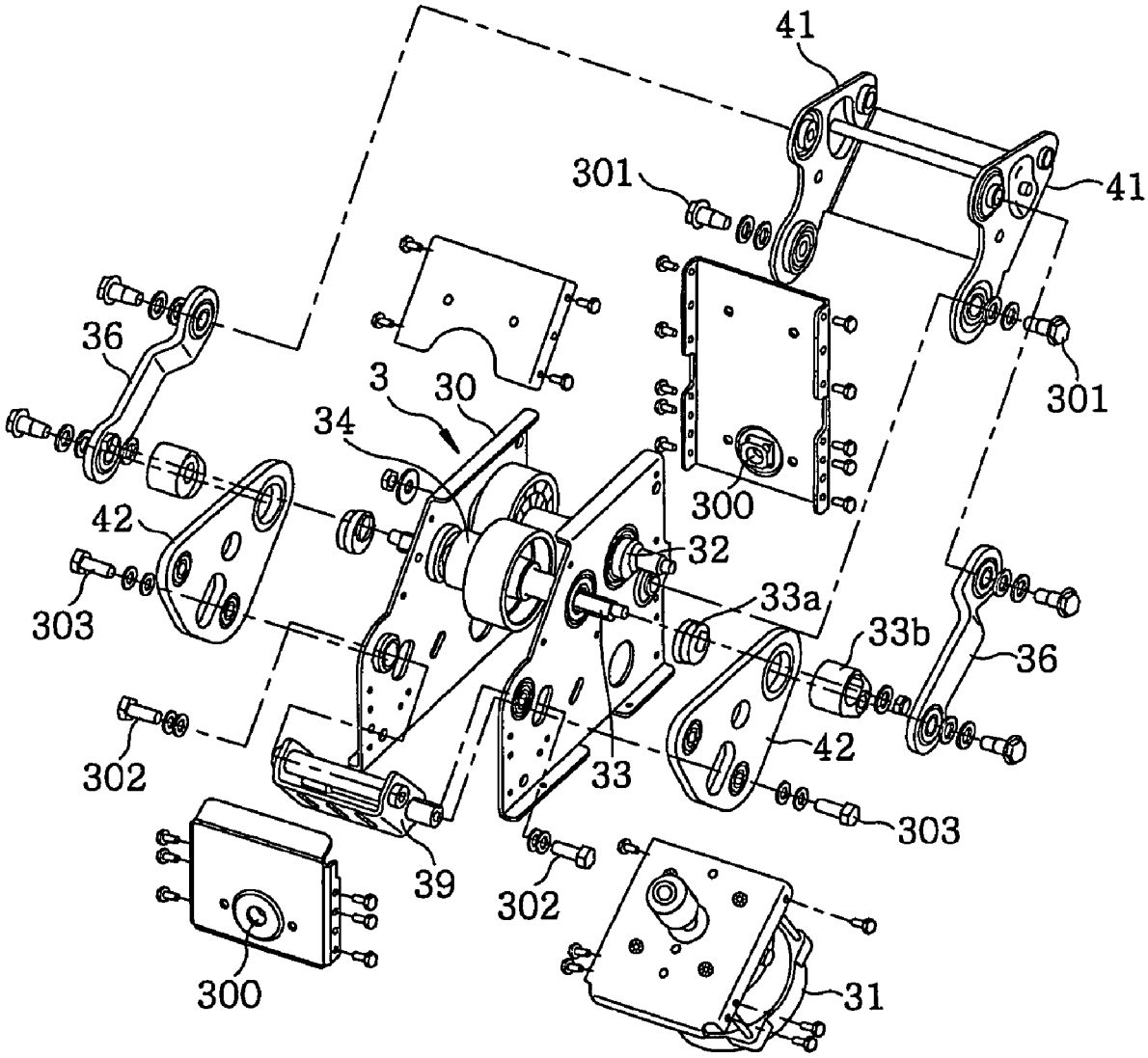
FIG. 10 is an exploded perspective view of the driving unit of the rocking type exercising apparatus.

Rotation of the off-centered portion of the output shaft 32 connected to the support frame 13 through the link 35 causes the movable frame 30 to reciprocatingly rotate about the shafts 130 (extending along the longitudinal axis A inclined in the forward/backward direction in FIG. 9).

Eccentric rotation of the off-centered portion 33*a* of the output shaft 33 causes the front end of the movable plate 40 to swing in the forward/backward and upward/downward directions through the intervention of the link plate 42 and the extensible/contractible actuator 45. Eccentric rotation of the off-centered portion 33*b* causes the rear end of the movable plate 40 to swing primarily in the forward/backward direction through the intervention of the connection link 36 and the link plate 41.

Assuming that the trajectory of forward/backward swinging movement of a joint shaft 40*a* for joining the link plate 41 and the movable plate 40 together is T1 and the trajectory of forward/backward swinging movement of a joint shaft 40*b* for joining the extensible/contractible actuator 45 and the movable plate 40 together is T2 as illustrated in FIG. 9, the strokes of both swinging movement are set equal to each other but the upward/downward movement components are set differently in the trajectories T1 and T2.

In addition, although the trajectory T1 is mainly moved in the forward/backward direction, the trajectory T2 has an increased upward/downward movement component in addition to the forward/backward movement component. This is because the shaft 303 of the link plate 42 is located rearwardly of the shaft 40*b*. Furthermore, the trajectory T2 goes forward and comes back via different routes deviated in the upward/backward direction, because the rotating plate 39 constituting one of the constituent parts for driving rocking motion of the front end of the movable plate 40 changes the position of the shaft 303 as a rotational axis of the link plate 42 in the upward/backward direction.

In this connection, the seat frame 20 of the seat 2 is fixed to the movable plate 40 that makes a rocking motion in the forward/backward and leftward/rightward directions as the output shafts 32 and 33 are rotated, whereby the seat 2 rocks together with the movable plate 40 in the forward/backward and leftward/rightward directions. The revolution number of the output shafts 32 and 33 is set to ensure that two cycles of the forward/backward rocking motion are performed during one cycle of the leftward/rightward rocking motion. A center point 21*a* of the seat surface member 21 of the seat 2 is positioned at a center in the leftward/rightward direction and at lowermost in the forward/backward direction. Two cycles of forward/backward rocking motion are performed during one cycle of leftward/rightward rocking motion, so that the center point 21*a* is described in a figure eight pattern, when viewed from the top, during the forward/backward and leftward/rightward rocking motion of the seat 2 as illustrated in FIG. 11A.

Figure 11A:
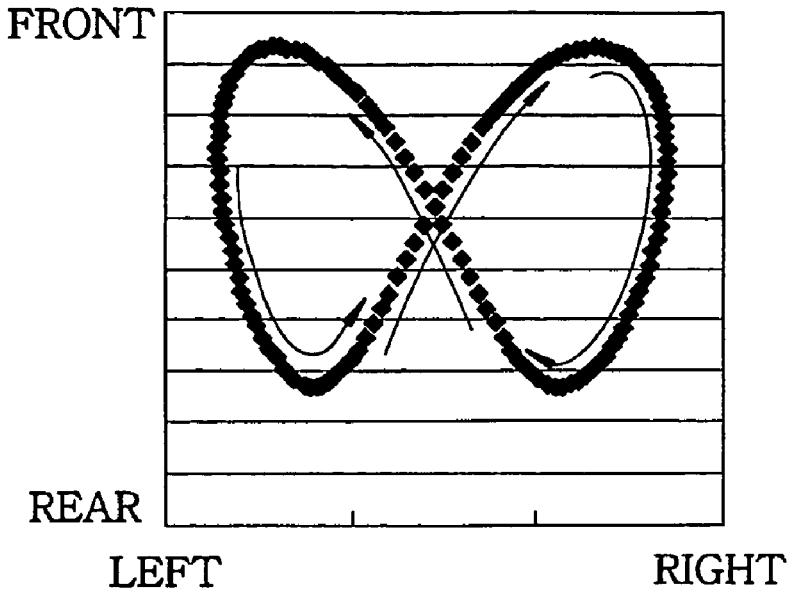
FIGS. 11A and 11B are views for explaining the operation of the rocking type exercising apparatus.
Figure 11B:
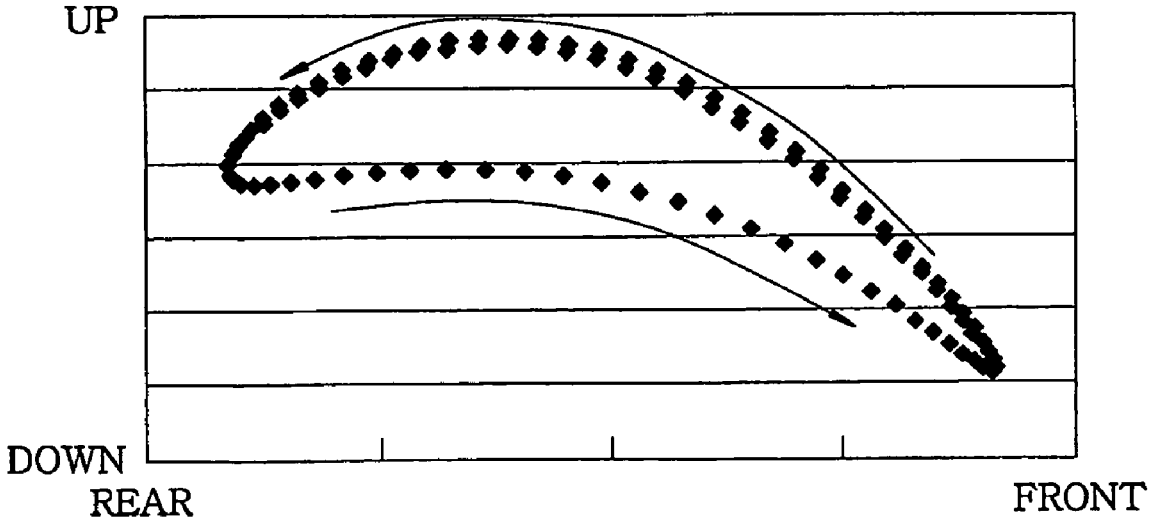

Due to the difference in the trajectories T1 and T2, the center point 21*a* of the seat 2 goes down while moving forward but goes up while coming back as illustrated in FIG. 11B.

Further, as illustrated above, the trajectory T1 of the rear end of the seat 2 signifies a forward/backward motion with a reduced upward/downward motion component, on the other hand, the trajectory T2 of the front end of the seat 2 stands for a forward/backward motion with an increased upward/downward motion component. Thus, the upward/downward motion of the seat 2 is performed in such a way that the front end is moved up and down with respect to the rear end. The user sitting on the seat 2 in a position substantially coinciding with the center point 21*a* of the seat 2 can accurately feel the motion of the seat 2, that is, the upward/downward movement of the front end with respect to the rear end lying behind the user.

FIGS. 11A and 11B are graphs obtained by plotting the movement of the center point 21*a* of the seat 2 at regular time intervals. In this graph, the section having a greater interval between dots signifies high speed movement and the section where a narrower interval is changed to a broader interval within a short period of time represents movement with increased acceleration. FIGS. 11A and 11B show that the acceleration at the forward motion is greater than the acceleration at the backward motion. A user, who sits on the seat 2 and takes the motions of the seat 2, feels a sense of forward movement. Therefore, the user can have a sense as if he or she enjoys actual horse riding.

The leftward/rightward rocking motion does not occur about a horizontal axis generally parallel to the movable plate 40 but about the longitudinal axis A whose front end is lower than its rear end. Accordingly, though the movable plate 40 performs a leftward/rightward rocking motion within an equal angular extent at the front and rear ends, the leftward/rightward stroke of the movable plate 40 at the front end is greater than the stroke at the rear end. This is because the vertical distance between the front end of the movable plate 40 and the longitudinal axis A is greater than the vertical distance between the rear end of the movable plate 40 and the longitudinal axis A.

The forward/backward rocking motion (pitching) is combined with the leftward/rightward rocking motion (rolling). In the figure eight pattern trajectory as observed from the top, the leftward/rightward motion width at the front side becomes greater than that at the rear side as is apparent in FIG. 11A. Furthermore, the forward tilting motion includes a yawing motion component by which the front end of the seat 2 is obliquely twisted forward and moved crisscross. Therefore, the user, who sits on the seat 2 and takes all the motions of the seat 2, cannot maintain a balance unless he or she copes with the yawing motion as well as the pitching and rolling motions. This is quite effective from the standpoint of balance training.

The extensible/contractible actuator 45 of the driving unit 3 is provided for the purpose of changing the forward/backward inclination angle of the seat 2. In response to the manipulation of the operation panel 8, the extensible/contractible actuator 45 is extended and contracted to change over the forwardly inclined posture and the backwardly inclined posture. In addition, the extensible/contractible actuator 45 may be allowed to perform extending and contracting motions in concert with the forward/backward and leftward/rightward rocking motions, thereby increasing or decreasing the upward/downward motion component.

If the forward/backward inclination angle of the seat 2 is changed, so are the loads applied to individual muscles (abdominal muscles, back muscles, front-of-thigh muscles and back-of-thigh muscles) of the user during the rocking motion of the seat 2. The change in the rocking speed may also lead to a change in the load intensity and the ratio of the loads applied to the individual muscles. In order for the user to be clearly aware of such change, the status of loads applied to the respective muscles is displayed on the operation panel 8 as will be set forth later. The status of load is decided based on the data obtained in advance as to how the myogenic potentials of the respective muscles vary with the difference in the forward/backward inclination angle and the rocking speed of the seat 2.

When the user sits on the seat 2 and takes all the motions of the seat 2, the user can enjoy the rocking motion in a safer manner by resting the foot on the stirrup members 7 and holding the rein 6 with the hands. The stirrup members 7 are designed so that the joint point between the connection piece 72 and the foot rest 70 can be adjusted in the vertical direction. This makes it possible to set the height of the stirrup members 7 in conformity with the physique and preference of the user.

The connection piece 72 is made of an elastic material and is freely bendable to the left and right. As is clear from the right stirrup member 7 shown in FIG. 4, the foot rest 70 joined to the outer surface of the connection piece 72 has a bottom portion that extends outwardly upwardly at an inclination angle $\alpha$. By allowing the foot rest 70 to be off-set outwardly, it becomes easy for the user to rest the foot on the foot rest 70. Once the foot is rested on the foot rest 70 of each of the stirrup members 7, the elastic connection piece 72 is bent to have the foot rest 70 move inwardly, thereby bring the bottom portion of the foot rest 70 into a horizontal state as is apparent from the left stirrup member 7 shown in FIG. 4. Therefore, when the feet are placed on the stirrup members 7, it is possible for the user to maintain a good posture with no possibility that an exceedingly high force is applied to the ankles or the knees.

Figure 1:
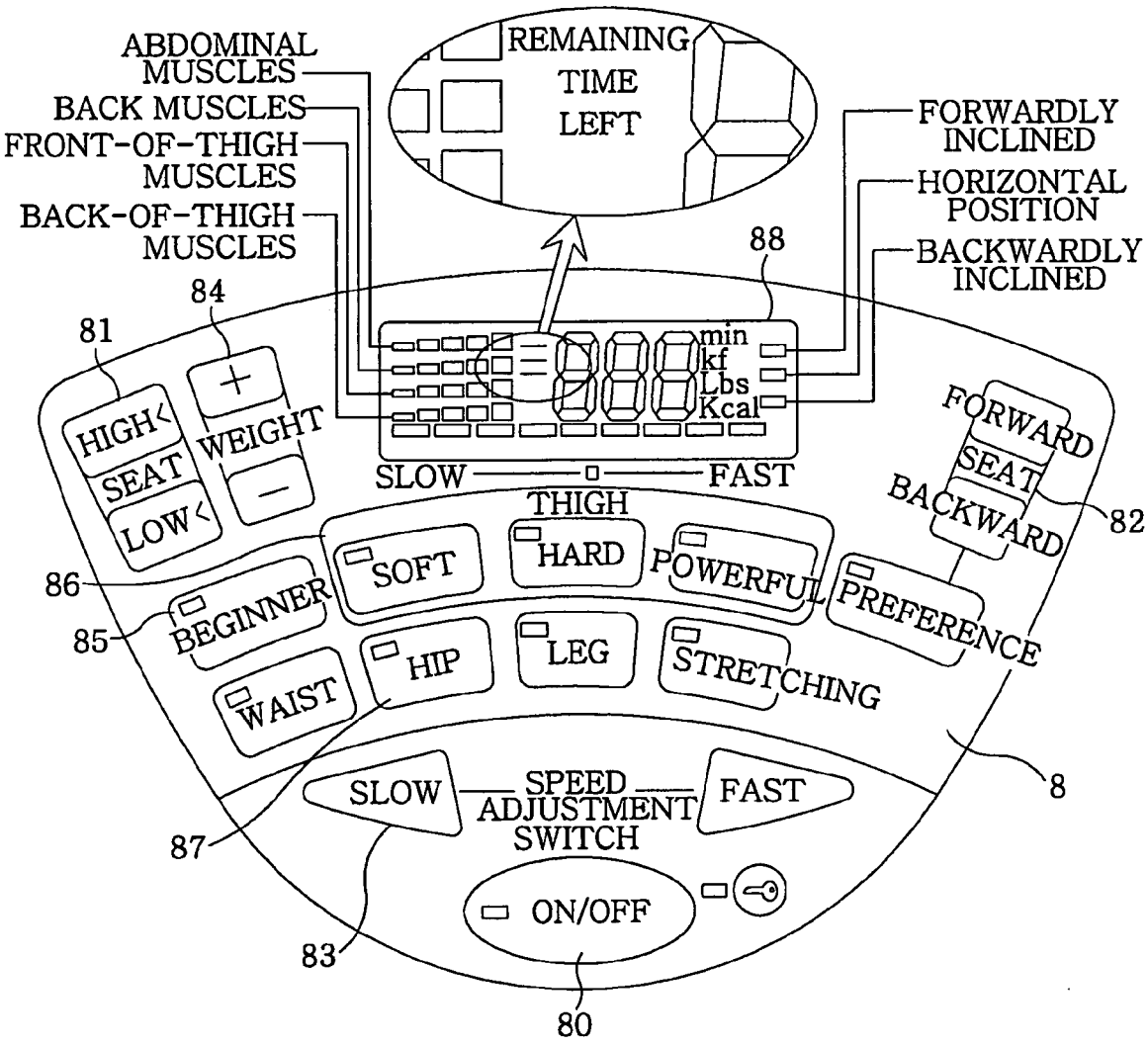
FIG. 1 is a front view showing an operation panel of a rocking type exercising apparatus in accordance with an embodiment of the present invention.

FIG. 1 shows the operation panel 8 of arranged in the front end portion of the seat 2. In this figure, reference numeral 80 designates a power switch, reference numeral 81 is a height adjustment switch for operating the electrical sliding unit 14 to adjust the height of the seat 2, reference numeral 82 designates an angle adjustment switch for operating the extensible/contractible actuator 45 to adjust the inclination angle of the seat 2, and reference numeral 83 designates a speed adjustment switch for changing the rotational speed of the motor 31 of the driving unit 3 to control the rocking speed.

Reference numeral 84 designates an up/down switch for inputting the weight value of a user, reference numeral 85 designates an operation mode selection switch for selecting a rocking motion to be suitable for a beginner, reference numeral 86 designates an operation mode conversion switch for converting the intensity of an exercise offered by the rocking motion, reference numeral 87 designates an exercise target conversion switch for converting an exercise target, and reference numeral 88 designates a display formed of a liquid crystal panel. Upon operating the exercise target conversion switch 87, the forward/backward inclination angle of the seat 2 is suitably converted by means of the extensible/contractible actuator 45.

The display 88 serves to indicate the inclination status of the seat 2, the speed adjustment status, the operation time, the exercise intensity, the calculated exercise amount (consumed calories), and the loads to be applied to abdominal muscles, back muscles, front-of-thigh muscles and back-of-thigh muscles by the speed change and the change in the forward/backward inclination postures of the seat 2 resulting from extension and contraction of the extensible/contractible actuator 45.

The exercise amount may be preferably calculated based on the rocking amount (data corresponding to the exercising amount per unit time) calculated in advance for respective forward/backward inclination postures and operation speeds of the seat 2, the inputted weight value, and the operation time. However, it may also be possible to install an acceleration sensor in the driving unit 3 or the seat 2 and calculate the exercise amount using acceleration data obtained from the acceleration sensor.

Figure 12:
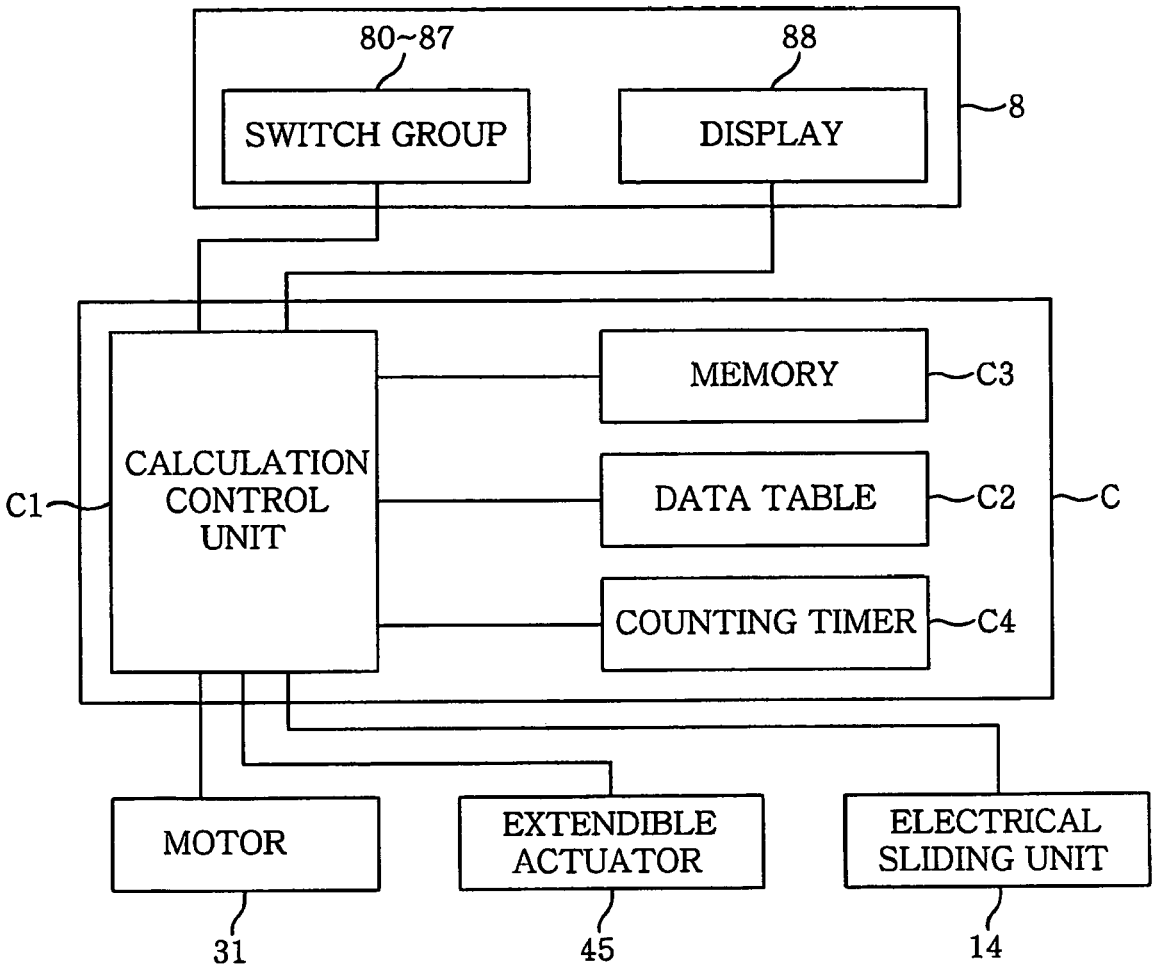
FIG. 12 is a block diagram showing a circuit of the rocking type exercising apparatus.

FIG. 12 shows one example of a control circuit C that controls the operation of the driving unit 3 in response to the manipulation of the switch group 80 to 87 of the operation panel 8 and performs display on the display 88. The control circuit C includes a calculation control unit C1, a data table C2, a memory C3 and a counting timer C4. The data table C2 stores: rocking data on the rocking motion amounts calculated in advance for the respective forward/backward inclination postures and operation speeds of the seat 2 to display consumed calories; and pre-obtained load data on the load values to be applied to different body regions depending on the forwardly inclined, backwardly inclined and horizontal postures attained by extension/contraction of the extensible/contractible actuator 45 and the operation speed. Furthermore, as set forth earlier, the load data is defined based on the data obtained in advance with respect to the change in the myogenic potentials of individual muscles depending on the change in the forward/backward inclination angles and the operation speeds of the seat 2.

The calculation control unit C1 reads out from the data table C2 the data corresponding to the posture of the seat 2 (the extension/contraction position of the extensible/contractible actuator 45) and the operation speed at that posture of the seat 2, and displays the loads to be applied to a plurality of body regions of the user (abdominal muscles, back muscles, front-of-thigh muscles and back-of-thigh muscles in this example).

Figure 13A:
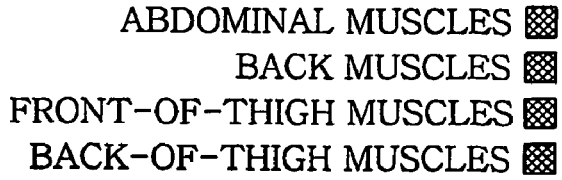
FIGS. 13A to 13E illustrate display examples in the operation panel of the rocking type exercising apparatus.
Figure 13B:
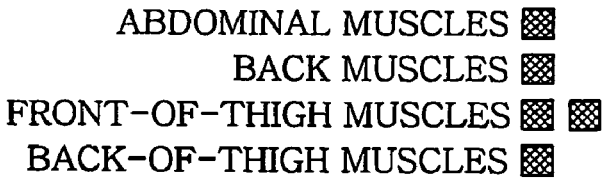
Figure 13C:
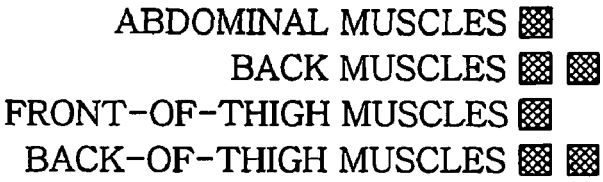
Figure 13D:
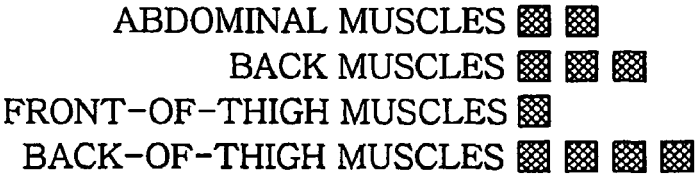
Figure 13E:
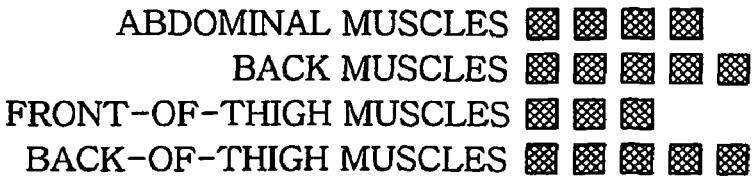

FIGS. 13A through 13E illustrate display examples of the loads applied to different body regions of the user depending on the change in the posture and the operation speed. Specifically, FIG. 13A illustrates the loads applied in case of a low speed and a horizontal posture. FIG. 13B illustrates the loads applied in case of a low speed and a forwardly inclined posture. FIG. 13C illustrates the loads applied in case of a low speed and a backwardly inclined posture. FIG. 13D illustrates the loads applied in case of an intermediate speed and a backwardly inclined posture and FIG. 13E illustrates the loads applied in case of a high speed and a backwardly inclined posture.

Therefore, it is possible for the user to know that the load to be applied to the front-of-thigh muscles becomes greater in case of the forwardly inclined posture and further that the load applied to the back-of-thigh muscles and the back muscles becomes greater in case of the backwardly inclined posture. The user is also able to know that the loads to be applied to different body regions generally increase as the operation speed increases. Furthermore, it is possible for the user to find out whether the current posture and operation speed meets the user's desire to train, e.g., the abdominal muscles.

The memory C3 serves to store the weight value or the like inputted by the user. The counting timer C4 is used in measuring the operation time.

In the embodiment described above, the trajectories illustrated in FIGS. 11A and 11B remains the same and the loads are displayed in correspondence to the change in the posture of the seat 2 and the operation speed. Alternatively, the trajectories illustrated in FIGS. 11A and 11B may be changed, in which case the loads applied to different body regions can be displayed by pre-storing the data corresponding to the respective trajectories as in the above-mentioned manner.

While the embodiment described above is directed to a rocking type exercising apparatus that allows a user to enjoy an exercise like horse riding, the present invention is not limited thereto. Alternatively, the present invention may be applicable to an apparatus of the type allowing a user to take an exercise like surfing for example by rocking a footrest on which the user stands. The present invention may also be applicable to an apparatus of the type enabling a user to take an exercise like walking by rocking a seat on which a user sits while individually moving up and down each of footrests on which each of the feet of the user is placed.

While the invention has been shown and described with respect to the embodiments, it will be understood by those skilled in the art that various changes and modifications may be made without departing from the scope of the invention as defined in the following claims.

What is claimed is:

1. A rocking type exercising apparatus comprising:

a movable unit on which a user rides;

a driving unit for causing the movable unit to perform a rocking motion;

a rocking motion changing means for changing the rocking motion of the movable unit driven to rock by the driving unit; and a display unit, responsive to the change in the rocking motion caused by the rocking motion changing means, for simultaneously displaying a plurality of individual loads applied to respective body regions of the user, wherein the movable unit includes a seat on which the user sits, the rocking motion changing means changes a forward/backward inclination angle of the seat, and the display unit displays loads to be applied to abdominal muscles, back muscles, front-of-thigh muscles and back-of-thigh muscles, wherein the display unit displays relative magnitudes of the loads applied to the abdominal muscles, the back muscles, the front-of-thigh muscles and the back-of-thigh muscles, and wherein the relative magnitudes of the loads is decided based on data obtained in advance as to how myogenic potentials of the abdominal muscles, the back muscles, the front-of-thigh muscles and the back-of-thigh muscles vary the differences in the forward/backward inclination angle and a rocking speed of the seat.

2. The rocking type exercising apparatus of claim 1, wherein the rocking motion changing means changes at least one of a posture, a speed and a movement trajectory of the movable unit.

3. A rocking type exercising apparatus comprising:

a movable unit on which a user rides;

a driving unit for causing the movable unit to perform a rocking motion;

a rocking motion changing means for changing the rocking motion of the movable unit driven to rock by the driving unit; and a display unit, responsive to the change in the rocking motion caused by the rocking motion changing means, for simultaneously displaying a plurality of individual loads applied to respective body regions of the user, wherein the movable unit includes a seat on which the user sits, wherein the display unit displays relative magnitudes of the loads applied to abdominal muscles, back muscles, front-of-thigh muscles and back-of-thigh muscles, and wherein the relative magnitudes of the loads is decided based on data obtained in advance as to how myogenic potentials of the abdominal muscles, the back muscles, the front-of-thigh muscles and the back-of-thigh muscles vary with differences in a forward/backward inclination angle and a rocking speed of the seat.

4. The rocking type exercising apparatus of claim 3, wherein the display unit displays the loads to be applied to the abdominal muscles, the back muscles, the front-of-thigh muscles and the back-of-thigh muscles by a speed change and a change in the forward/backward inclination posture of the seat.

5. The rocking type exercising apparatus of claim 1, wherein the display unit displays the loads to be applied to the abdominal muscles, the back muscles, the front-of-thigh muscles and the back-of-thigh muscles by a speed change and a change in the forward/backward inclination posture of the seat.

6. A rocking type exercising apparatus comprising:

a movable unit on which a user rides;

a driving unit for causing the movable unit to perform a rocking motion;

a rocking motion changing means for changing the rocking motion of the movable unit driven to rock by the driving unit; and a display unit, responsive to the change in the rocking motion caused by the rocking motion changing means, for simultaneously displaying a plurality of individual loads applied to respective body regions of the user, wherein the rocking motion changing means permits the selection of a plurality of predetermined rocking motions, and the display unit indicates a magnitude of each load relative to a magnitude of other loads for each selected rocking motion.

* * * * *